US005894953A

United States Patent [19]

Ramirez

[11] Patent Number: 5,894,953

[45] Date of Patent: Apr. 20, 1999

[54] VENTED BOWL AND COVER ASSEMBLY

[75] Inventor: Richard L. Ramirez, Lawrenceville, Ga.

[73] Assignee: Tekni-Plex, Inc., Somerville, N.J.

[21] Appl. No.: 08/660,980

[22] Filed: Jun. 12, 1996

[51] Int. Cl.[6] ..... A47G 19/00; B65D 51/16

[52] U.S. Cl. ..... 220/785; 206/508; 206/519; 220/574; 220/584; 220/366.1

[58] Field of Search ..... 220/780, 781, 220/785, 786, 784, 788, 795, 366.1, 371, 378, 380, 367.1, 574; 206/508, 509, 519

[56] References Cited

U.S. PATENT DOCUMENTS

| | | | |
|---|---|---|---|
| 3,216,148 | 11/1965 | Amberg | 220/785 X |
| 3,675,811 | 7/1972 | Artz | 220/784 X |
| 3,739,976 | 6/1973 | MacDaniel | 220/780 |
| 3,794,090 | 2/1974 | Commisso | 220/785 X |
| 3,955,710 | 5/1976 | Commisso | 220/784 |
| 4,341,324 | 7/1982 | Ramirez . | |
| 4,390,113 | 6/1983 | Bird | 220/785 |
| 4,421,244 | 12/1983 | Van Melle | 220/781 |
| 5,312,011 | 5/1994 | Fischer | 206/508 X |

*Primary Examiner*—Stephen Castellano
*Assistant Examiner*—Niki M. Eloshway
*Attorney, Agent, or Firm*—Anthony J. Cassella; Gerald E. Hespos; Ludomir A. Budzyn

[57] ABSTRACT

A bowl cover assembly having a configuration which provides for secure interlocking between the bowl and cover with at least one opening for venting purposes along the rim of the cover when the cover is locked onto the bowl.

10 Claims, 5 Drawing Sheets

VENTED BOWL AND COVER ASSEMBLY

FIELD OF THE INVENTION

The present invention relates to a bowl and cover assembly and more particularly to disposable bowls and covers having a configuration which provides for interlocking between the bowl and cover with at least one opening for venting purposes along the rim of the cover when the cover is locked onto the bowl.

BACKGROUND AND SUMMARY OF THE INVENTION

Numerous types of bowl and cover assemblies and means for effecting a closure of the cover on the bowl have been devised. However, the present invention provides a bowl and cover which may be easily fabricated from an expanded foam plastic sheet whereby the skirt of the cover contains a semicircular locking member with an interspersion of undercut grooves for venting purposes. Likewise, the present invention provides a lid configuration whereby a plurality of lids can be stacked without creating a vacuum between adjacent stacked lids and thereby preventing vacuum locking. The elimination of vacuum locking allows the covers to be more easily and quickly handled.

Finally, the present invention fills a need in the packaging art for a lightweight disposable container for hot take-out food, such as Japanese or Chinese food. Heretofore, such containers have often been paper cartons which have little heat retention capabilities and exhibit various undesirable structural features. Foam containers have increased heat retention capabilities over paper cartons, however, heretofore such foam containers, as in U.S. Pat. No. 4,341,324, have generally provided for vacuum sealing when the cover is placed onto the bowl. When hot food is vacuum sealed within the container, the container becomes distorted in shape and such distortion often causes the vacuum seal to break, which in turn causes the cover and bowl to separate. The present invention eliminates the problems of paper containers and cartons, and the problems of vacuum sealed foam containers, and provides a container that is capable of retaining its shape and the seal between the bowl and cover when hot food is placed inside, whereby the freshness and heat of the food contained therein is retained.

The present invention comprises a bowl and cover assembly wherein the bowl includes a bottom, an upper annular rim and upwardly extending side walls rising from the margin of the bottom and terminating in the upper annular rim. An integrally formed annular interlocking lip depends radially outward from the annular rim. The annular interlocking lip comprises an annular top sealing surface and an annular edge sealing surface depending downwardly from the margin of the top sealing surface about the peripheral edge of the annular interlocking lip, and the seal between the cover and the bowl is interrupted at at least one location along its annular edge whereby to provide an opening into said bowl and cover assembly.

In another embodiment, on the inside of the annular skirt of the cover are interspersed undercut grooves for venting purposes, numbering six in this embodiment. Between each set of neighboring undercut grooves is a radially inwardly protruding semicircular interlocking bead which extends almost to the edge of each undercut groove. This bead acts as a locking member when the cover is placed on the bowl because the diameter of the semicircular bead is smaller than the diameter of the lip of the bowl.

In yet another embodiment, between the edge of the semicircular interlocking bead and the edge of an undercut groove is a section of thinned foam that lacks the semicircular interlocking bead. Because such section lacks the additional foam used to form the semicircular interlocking bead, and because no interlocking takes place between the cover and the bowl at that location, the cover is more flexible and such configuration allows for annular spring action making it easier to place one'ss fingers under the annular skirt of the cover and remove the cover from the bowl.

In yet another embodiment, the annular skirt of the cover may include an annular trim lip integrally formed with the cover which defines a radially protruding circumferential member extending from the lower edge of the lower downwardly depending portion of the annular skirt remote from the peripheral flange. The junction between the trim lip and the lower downwardly depending portion defines an inwardly facing stacking heel. The shape and circumferential length of the annular skirt and the domed panel of the lid are then selected so that the stacking heel of the upper cover will rest on the annular skirt shoulder of the lower cover thereby preventing formation of a partial vacuum between the upper and lower covers when they are stacked on top of one another.

BRIEF DESCRIPTION OF THE DRAWINGS

A complete understanding of the present invention and of the above and other advantages thereof may be gained from a consideration of the following description of the preferred embodiment taken in conjunction with the accompanying drawings in which.

DETAILED DESCRIPTION OF THE INVENTION

Figure 1:
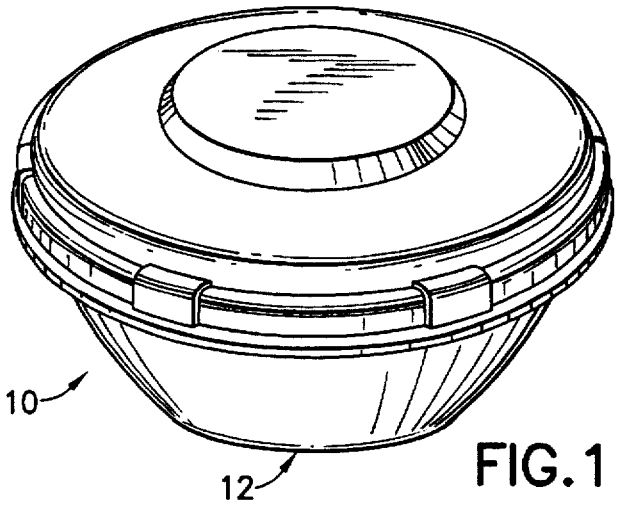
FIG. 1 is a perspective view of a bowl and cover assembly in accordance with the invention.
Figure 2A:
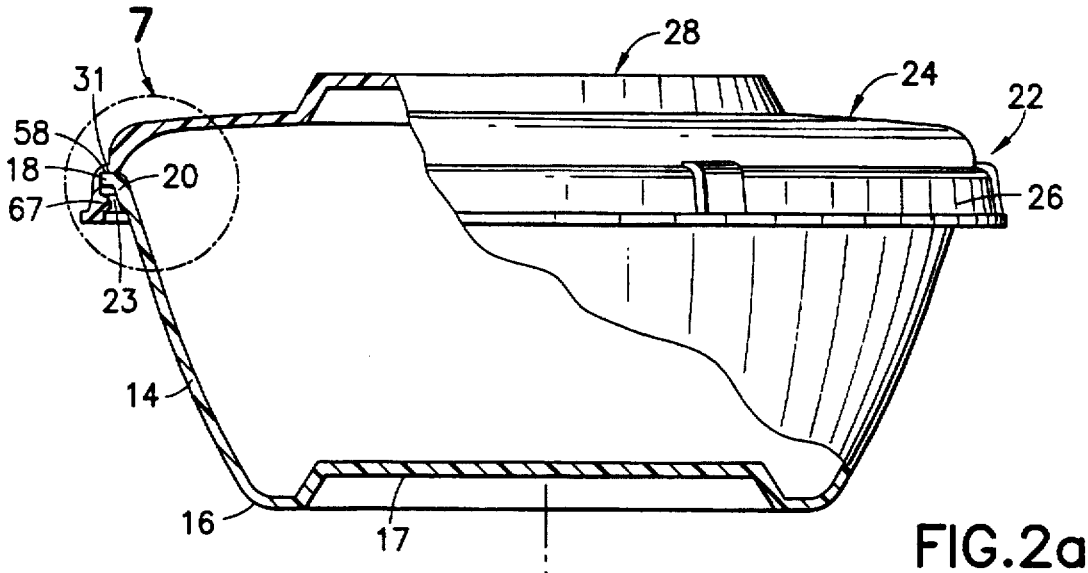
FIGS. 2*a* and 2*b* are two partial cutaway plan views of a bowl and cover assembly in accordance with the invention.
Figure 2B:
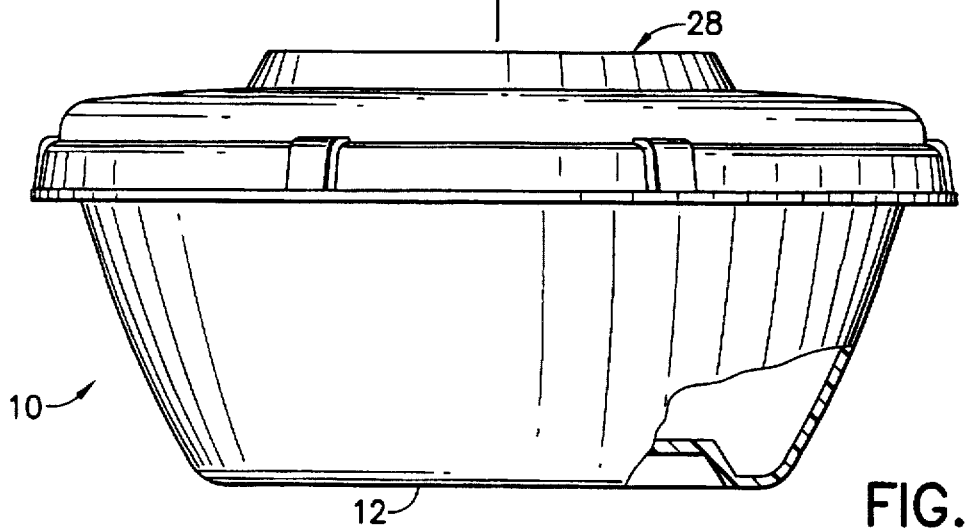

Referring initially to FIGS. 1 and 2, the invention comprises a bowl 10 and cover 22 assembly. The bowl 10 preferably is formed from plastic foam, having an integrally formed bottom 12 and side walls 14 arising from the margin 16 of the bottom 12 and terminating in an upper annular rim 18. An integrally formed annular interlocking lip 20 extends radially outward from the upper annular rim 18 of the bowl 10. The bottom 12 may be of any suitable shape and may for example have an inwardly tapered surface 17 so that the bowl contacts a support surface only at the annular margin 16.

The side walls of the bowl 10 may comprise a plurality of interconnected side walls in the case of a square or rectangularly cross-sectioned container or other similarly shaped container with corner regions. Alternatively, the side walls may comprise a single side wall 14 having an oval or circular cross-section without corners. In a particularly suitable and preferred embodiment, the side wall 14 has a circular cross-section as shown in the figures and has an outer surface whose slope increases from the margin 16 to the upper annular rim 18. Thus, a section through the side walls 14 would define a generally parabolic or hyperbolic shape truncated at the margin 16 of the bottom.

A cover 22 is, like the bowl 10, preferably integrally formed from foam plastic sheet material and includes a domed panel 24 with an annular skirt 26 depending downwardly therefrom, and a central protrusion 28 extending upwardly from the domed panel 24. The inside dimensions of the annular skirt 26 are selected so that the cover 22 will initially fit over the annular interlocking lip 20 of the bowl 10 and thereafter as the cover 22 is pressed downwardly, the semicircular locking member 67 of the annular skirt 26 will come in contact with the edge of the annular interlocking lip 20 causing the annular interlocking lip 20 to deflect inwardly and the annular skirt 26 to deflect outwardly until the annular interlocking lip 20 passes over the semicircular locking member 67 and into the locking area 23, at which point the edge of the annular interlocking lip 20 will come into resting contact with the inner top edge 58 of the annular skirt 26. The annular interlocking lip 20 thereupon seats in the interior surfaces of the annular skirt 26 in a manner to be discussed hereafter to form a secure interlock between the cover and the bowl.

When a first bowl 10 is stacked on top of the cover 22 of a second identical bowl 10, the central protrusion 28 of said second bowl nests within the inwardly tapered surface 17 of the bottom 12 of said first bowl 10. The dimensions of the central protrusion 28 are selected so that the periphery of the inwardly tapered surface 17 is slightly larger that the periphery of the central protrusion 28, thereby ensuring stackability of two or more bowl and cover assemblies.

Figure 7:
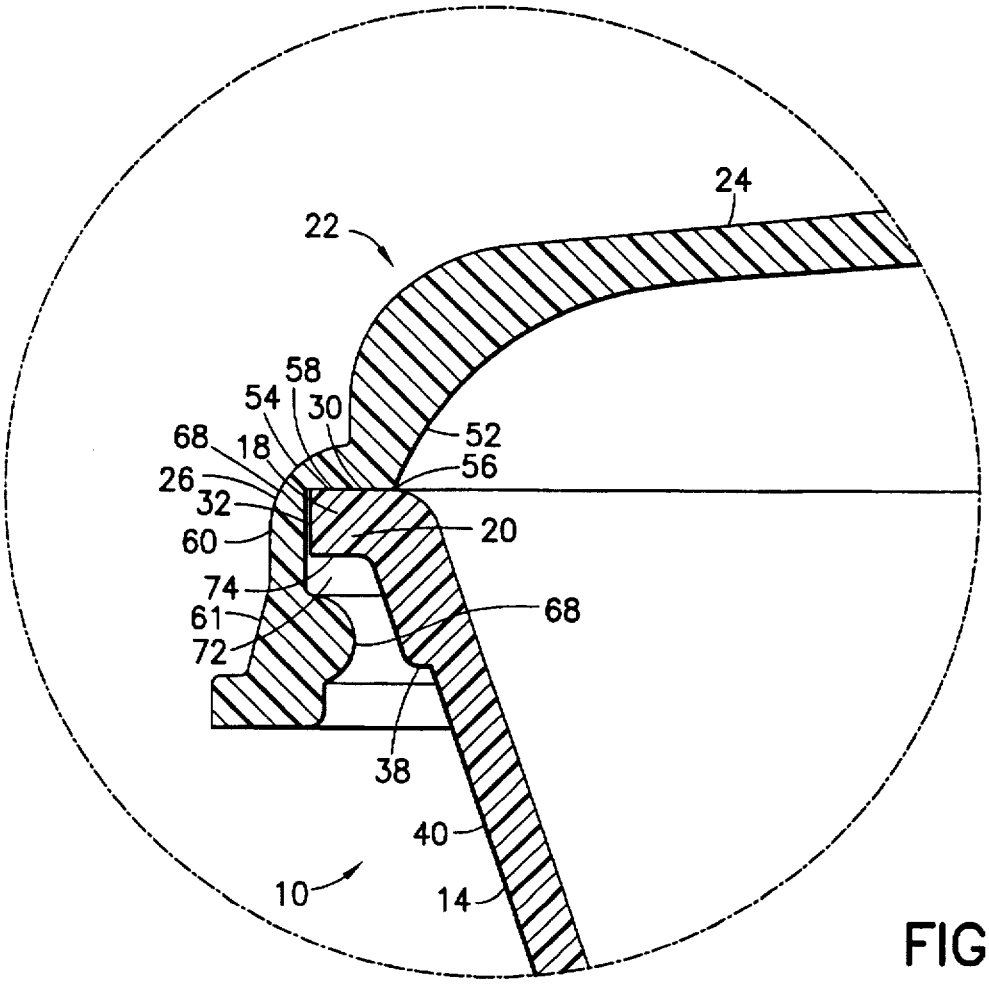
FIG. 7 is a sectional view of the present invention, taken on section 7 of FIG. 2*a*, illustrating the lid when it is fully locked onto the bowl.

Referring now more particularly to FIG. 7, the outwardly depending annular interlocking lip 20 extends outwardly from the upper annular rim 18 of the bowl 10, to define a upwardly facing annular top sealing surface 30 and a side facing annular edge sealing surface 32. The edge sealing surface 32 is perpendicular to the outer edge of the top sealing surface 30.

The bowl 10 also comprises a down-facing peripheral stacking shoulder 38 extending outwardly from the outer surface 40 of the side wall 14 of the bowl 10 to facilitate the stacking of the bowls.

Figure 11:
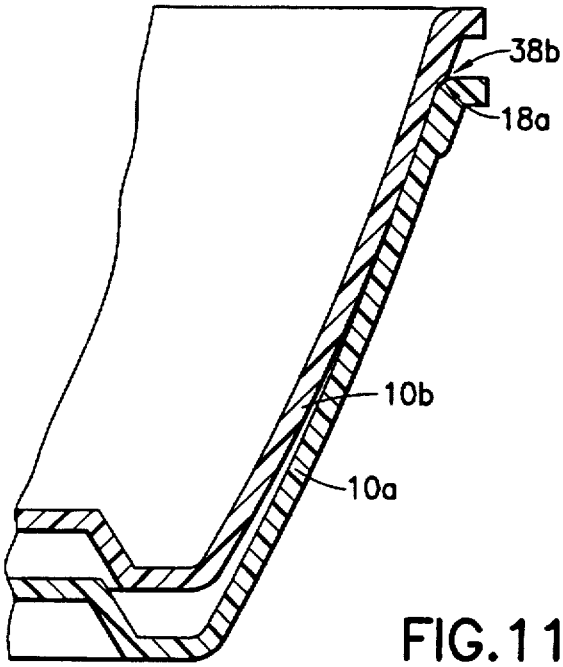
FIG. 11 is a sectional view of two bowls in a stacked configuration.

Referring more specifically to FIG. 11 in this regard, two bowls **10*a* and 10*b* are illustrated in a stacked configuration whereby the stacking shoulder 38*b* of bowl lob rests on the upper annular rim 18*a* of bowl 10*a***.

Figure 6:
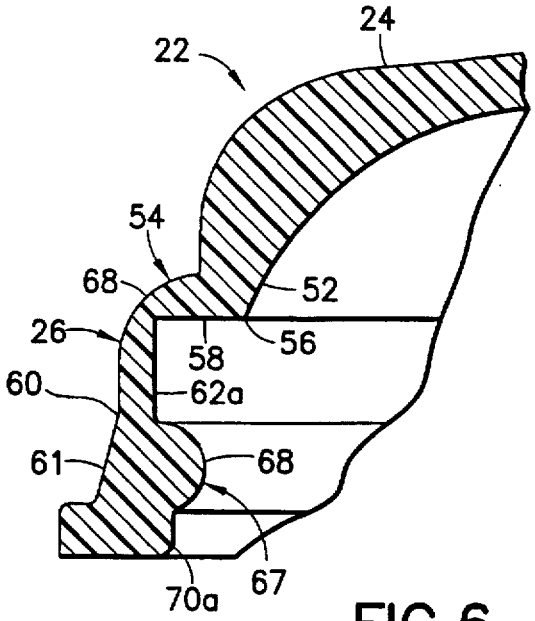
FIG. 6 is a sectional view, of a portion of the cover, showing the edge region of the cover in accordance with the invention and showing the interlocking member of the lid with lock area, taken on section lines 6—6 of FIG. 4.
Figure 8:
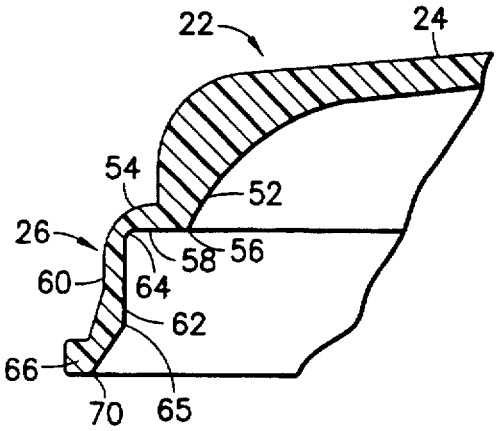
FIG. 8 is a sectional view of a portion of the cover without the lock area, taken on section lines 8—8 of FIG. 4.

Referring now to FIGS. 6, 7 and 8, the annular skirt 26 of the cover 22 extends outwardly and downwardly from an outwardly and downwardly extending peripheral flange 52 of the domed panel 24. In the preferred embodiment, the annular skirt 26 includes an upper portion 54 depending generally laterally from the lower edge of the downwardly extending peripheral flange 52. The internal junction between the upper laterally depending portion 54 and the downwardly extending peripheral flange 52 defines an annular heel 56. An interior down-facing surface 58 extends radially outward from the annular heel 56 on a horizontal plane. The annular skirt 26 also comprises a lower downwardly depending portion 60 with the outside facing surface 61 being slightly outwardly flared. The transition between the upper laterally depending portion 54 and the lower downwardly depending portion 60 defines an outer generally upwardly facing skirt shoulder 68.

Referring particularly to FIG. 8, said lower downwardly depending portion 60 generally defines an vertical inwardly facing mating surface 62 that extends downwardly from an annular junction 64 (at which the annular inwardly facing mating surface 62 meets the down facing mating surface 58) and reaches a second annular heel 65 and then flares outward terminating at an annular trim lip 66 which defines a radially protruding circumferential lip member extending from the lower edge of the lower downwardly depending portion 60 of the annular skirt 26. The outwardly flared transition region between the lower downwardly depending portion 60 and the annular trim lip 66 generally defines an inwardly directed stacking heel 70.

Referring particularly to FIG. 6 in conjunction with FIG. 7, said lower downwardly depending portion 60 has a vertical inwardly facing mating surface **62*a* with a semicircular locking member 67, and below said locking member 67 is a slightly curved stacking heel 70*a*. The internal diameter of the cover 22 at vertical inwardly facing mating surface 62*a* is approximately equivalent to the maximum diameter of the annular interlocking lip 20 of bowl 10. The minimum internal diameter of the annular semicircular locking member 67 is smaller than the maximum diameter of the annular interlocking lip 20 by a length generally the size of the radius of the semicircular locking member 67. Thus, as the cover 22 is placed over the annular interlocking lip 20 of bowl 10, the annular edge surface 32 of bowl 10 mates with the vertical inwardly facing mating surface 62*a* of annular skirt 26. The semicircular locking member 67 serves to keep the cover 22 locked onto the annular interlocking lip 20 of bowl 10. When the cover 22 is locked onto the bowl 10, an airspace 72 exists between the top of the semicircular locking member 67 and the bottom horizontal annular edge 74 of the annular interlocking lip 20 of bowl 10**.

Figure 9:
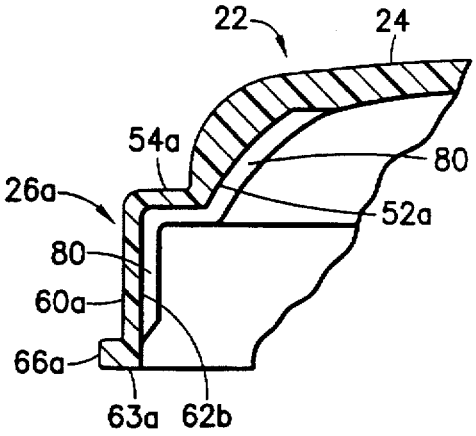
FIG. 9 is a sectional view of the cover through one of the vent areas, taken on section lines 9—9 of FIG. 4.
Figure 12:
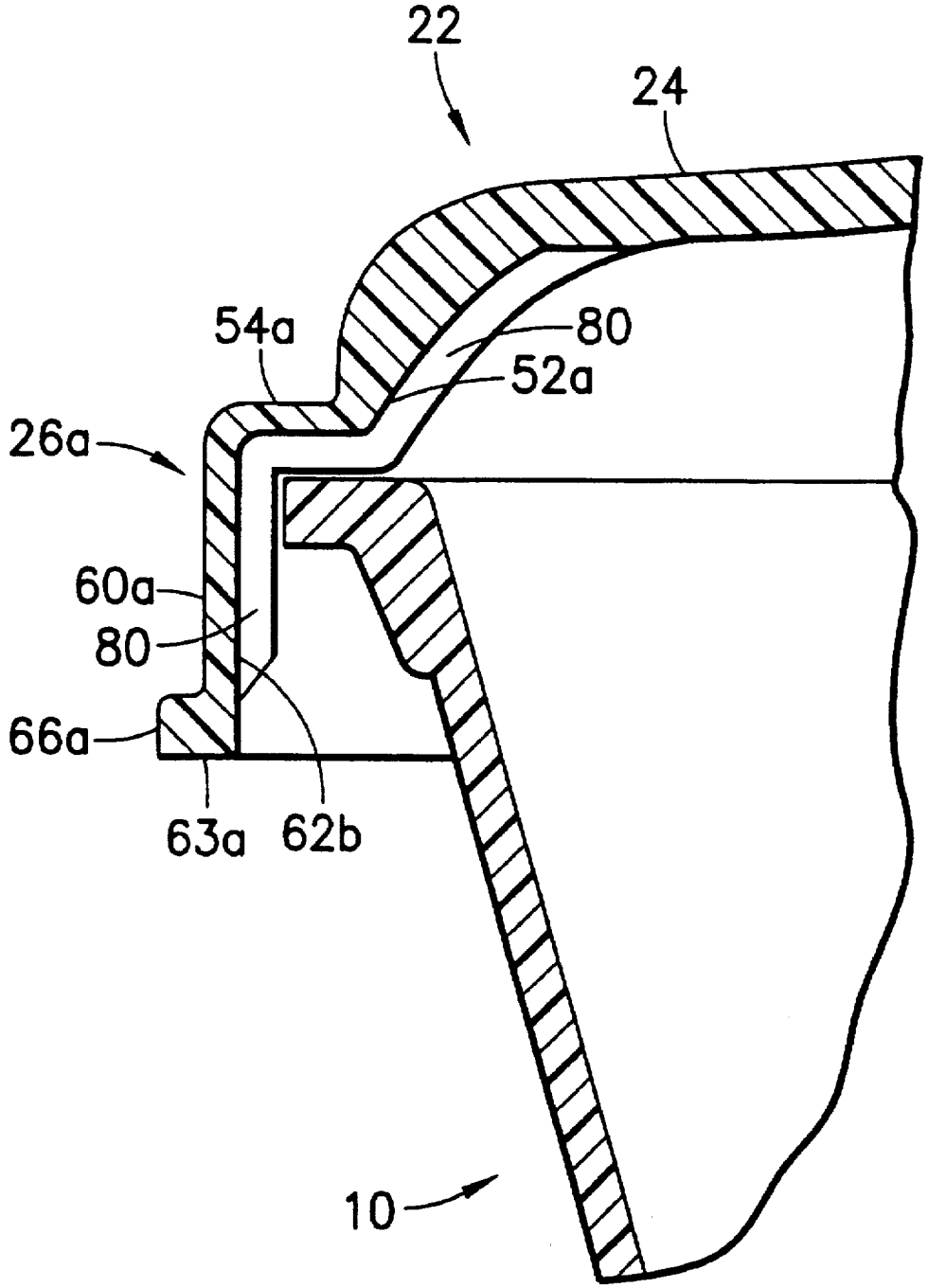
FIG. 12 is a sectional view of the present invention through one of the vent areas, taken on section lines 9—9 of FIG. 4, when the cover is fully locked onto the bowl.

Referring to FIGS. 9 and 12, the annular skirt **26*a* of the cover 22 extends outwardly and downwardly (without a flare) from an outwardly and downwardly extending peripheral flange 52*a* of the domed panel 24. In the preferred embodiment, the annular skirt 26*a* includes an upper portion 54*a* depending laterally from the lower edge of the downwardly extending peripheral flange 52*a*, said upper portion 54*a* extending laterally across a greater distance than the laterally depending portion 54 found in FIGS. 6, 7, and 8. The lower depending portion 60*a* of annular skirt 26*a* extends vertically downward (unlike the downwardly depending portion 60 in FIGS. 6, 7, and 8, which flares outwardly) and terminates at an annular trim lip 66*a*. The downwardly depending portion 60*a* has a vertical inwardly facing mating surface 62*b* which connects the bottom horizontal portion 63*a* of the trim lip 66*a* at an annular heel 70*a*. When the cover 22 is in an interlocked position with bowl 10, the annular skirt 26*a* does not connect with the bowl 10 because a vented air space 80** prevents such a connection, thus allowing air to pass into and out of the bowl and cover assembly.

Figure 3:
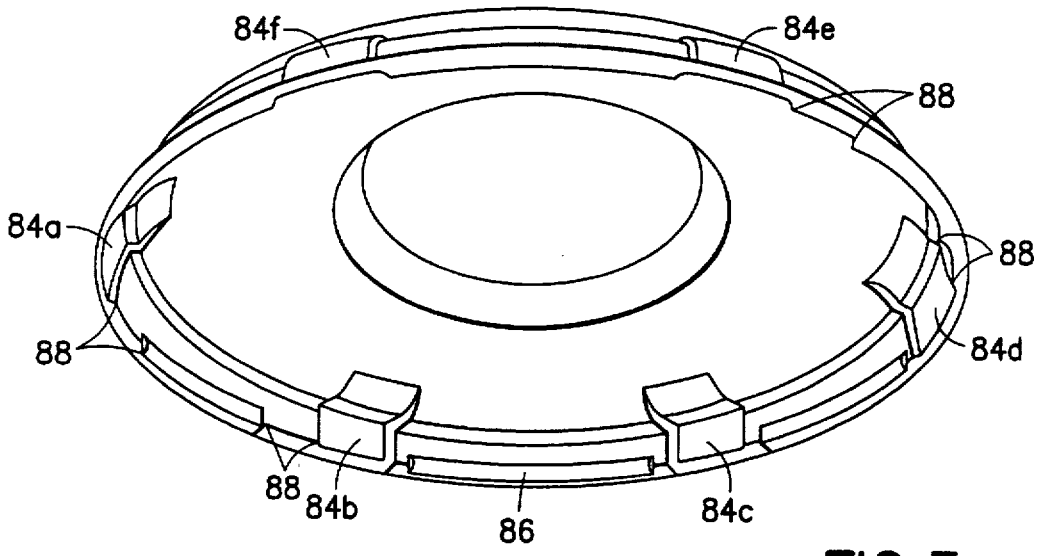
FIG. 3 is a bottom perspective view of the cover.
Figure 4:
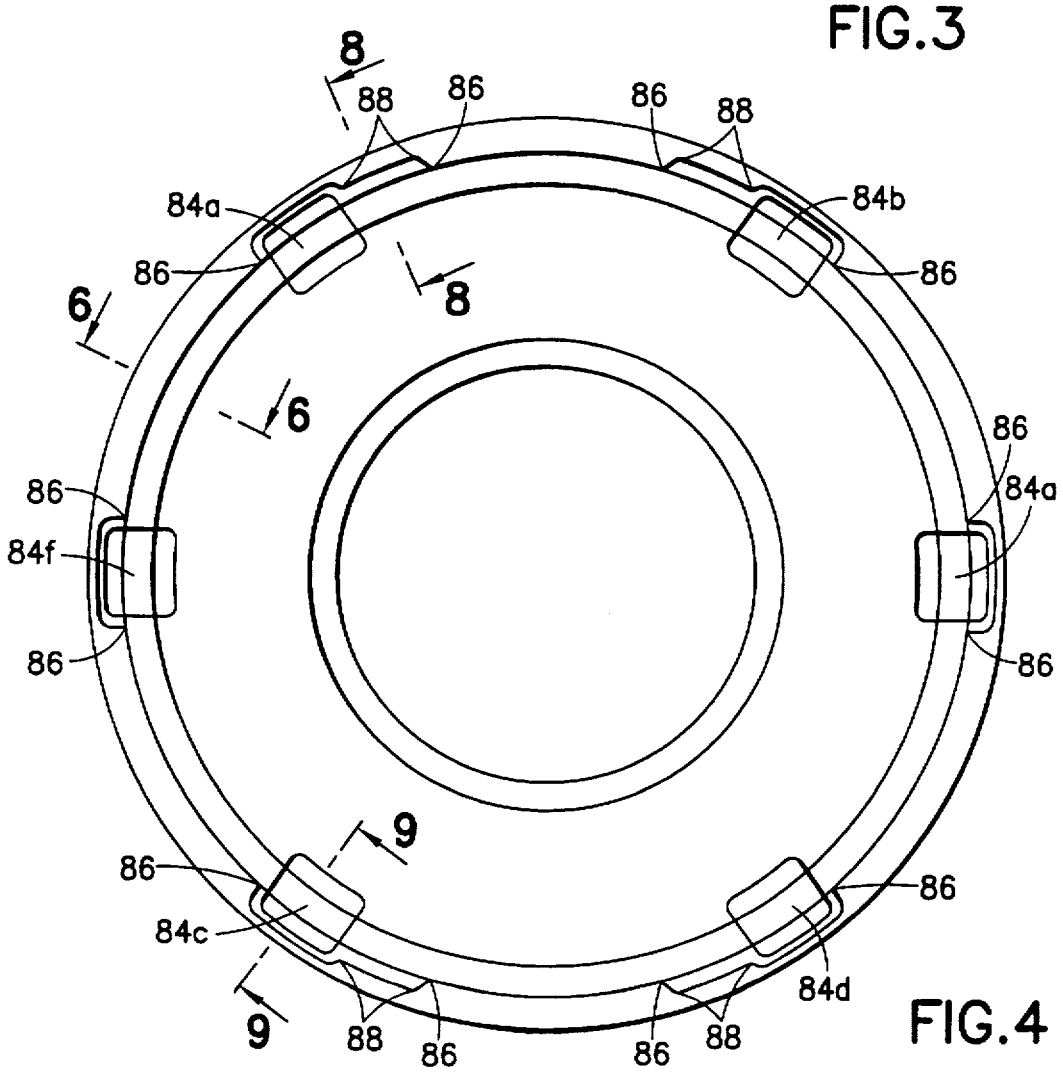
FIG. 4 is a bottom view of the cover.
Figure 5:
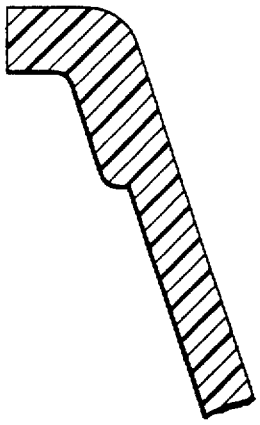
FIG. 5 is a side, partial sectional plan view, showing a detail of the lip of the bowl.

Referring to FIGS. 3 and 4, the undercut grooves 84*a*, 84*b*, 84*c*, 84*d*, 84*e*, 84*f* allow for venting when cover 22 is locked onto the bowl 10. In the preferred embodiment, a series of six undercut grooves exist, although this number could be varied. Between the each set of neighboring undercut grooves (i.e., between 84*a* and 84*b*, between 84*b* and 84*c*, etc.) is a stretch of semicircular interlocking member 86. The stretch of semicircular interlocking member 86 extends almost to the edge of each undercut groove except at four sections 88 immediately adjacent to four of the undercut grooves, in this case 84*a*, 84*b*, 84*d*, 84*e*, where the semicircular interlocking member is not formed and the foam is thinned, thereby allowing flexibility and annular spring action at sections 88 due to such sections containing a thinner amount of foam.

Figure 10:
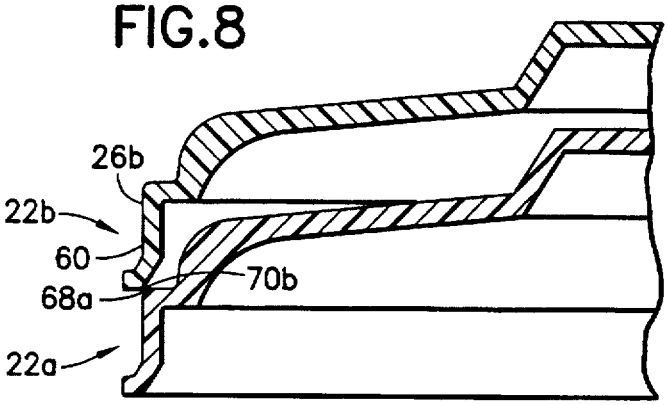
FIG. 10 is a sectional view of two lids in a stacked configuration in accordance with the invention.

Referring to FIG. 10, in conjunction with FIG. 8, the length of the lower downwardly depending portion 60 is selected so that when several covers such as the covers 22*a* and 22*b* are stacked prior to use, the stacking heel, for example stacking heel 70*b* of the cover 22*b*, will rest on the upwardly facing skirt shoulder 68*a* of the lower cover 22*a*. The combination of the resiliency of the skirt 26*b* of the cover 22*b* and the fact that the point of contact between the stacking heel 70*b* and the upwardly facing skirt shoulder 68*a* tends more towards being in a horizontal plane rather than a vertical plane, allows a number of covers to be stacked one on top of the other without creating a vacuum between adjacent covers. This prevents vacuum locking which hinders separation of the covers when it is desired to remove a cover from the stack and place a lid on one of the bowls.

Although the above description has been made with reference to a particular embodiment of the invention, it will be appreciated that variations and modifications may be made in the above structure without departing from the spirit of the invention. For example, the width of the annular sealing lip 20 may vary rather substantially about the periphery of the bowl so long as the periphery of the annular sealing lip matches the shape and size of the annular inwardly facing mating surface 62 of the cover in the manner previously described. In addition, the interlocking member 67 need not be semicircular, but could be other shapes such as semi-oval, square, triangular and the like.

The foregoing is meant to illustrate, but not to limit, the scope of the invention. Within the scope of the present claims are other embodiments or modifications which one skilled in the art is capable of making, based on the teachings herein and what is known in the art, without undue experimentation.

What is claimed is:

1. A bowl and cover assembly, comprising:

a bowl comprising:

a bottom, an upper annular rim, and upwardly extending side walls rising from the margin of the bottom and terminating at said annular rim, a portion of said annular rim defining an annular lip;

and a cover comprising:

a domed panel having a downwardly extending peripheral flange thereabout, and an integrally formed annular skirt depending generally outwardly and downwardly from the peripheral flange, the inside surface of said annular skirt being formed with a locking member extending therefrom, said locking member designed to lockingly engage the annular lip of said bowl, said inside surface also being formed with a groove recessed therein, said groove being circumferentially spaced from said locking member, and said inside surface defining a radially an inwardly facing transition surface between said locking member and said groove;

wherein, a discontinuous annular seal is formed by contact between the annular rim of said bowl and the annular skirt of said cover, with said groove defining a discontinuity in said annular seal, whereby said discontinuity provides a vent for said bowl and cover assembly, when said cover is securely interlocked onto said bowl.

2. The bowl and cover assembly of claim 1 wherein the annular lip of said bowl has a single annular top sealing surface and a single annular edge sealing surface depending downwardly from the top sealing surface and defining the outermost peripheral edge of the annular lip; and wherein said annular skirt is defined by an upwardly facing annular skirt shoulder around the outside surface of the cover and an inwardly facing annular heel at the junction between the peripheral flange and the annular skirt, the annular skirt comprising an upper laterally depending portion having a laterally disposed down facing mating surface, and a lower downwardly depending portion having an annular inwardly facing mating surface, said down facing mating surface adapted for contacting the top sealing surface of the bowl and the edge sealing surface adapted for contacting an annular portion of the inwardly facing mating surface.

3. The bowl and cover assembly of claim 1 or 2 wherein said inside surface of said annular skirt is formed with a plurality of circumferentially-spaced grooves recessed therein.

4. The bowl and cover assembly of claims 1 or 2 wherein said bowl further comprises an external downwardly facing stacking shoulder positioned for resting on an upper annular rim of a second similarly shaped bowl when said bowl is nested within the inside of said similarly shaped bowl.

5. The bowl and cover assembly of claims 1 or 2 wherein the annular skirt of the cover further comprises an annular trim lip integrally formed with the cover for defining a radially protruding circumferential member extending from the lower edge of the lower downwardly depending portion of the annular skirt remote from the peripheral flange, the junction between the trim lip and the lower downwardly depending portion defining an inwardly facing stacking heel, the length and shape of the annular skirt and the domed panel of the cover being selected so that the stacking heel of said cover rests on an annular skirt shoulder of a lower cover for preventing formation of a partial vacuum between said cover and said lower cover when the two covers are so stacked on top of one another.

6. The bowl and cover assembly of claims 1 or 2 wherein said bottom of said bowl is comprised of an inwardly tapered surface, and said domed panel of said cover is comprised of an upwardly extending raised panel, whereby the selection of dimensions of said inwardly tapered surface are slightly larger than the dimensions of said raised panel, such that said raised panel of said cover can nest within said inwardly tapered surface of said bowl when said bowl is stacked on top of said cover.

7. The bowl and cover assembly of claims 1 or 2 wherein the bowl and cover assembly is formed from plastic foam material.

8. The bowl and cover assembly of claim 1, wherein the portion of said annular skirt of the cover located between said groove and said locking member and defining said transition surface is cross-sectionally formed thinner than the portion of the annular skirt from which said locking member extends.

9. A bowl and cover assembly, comprising:

a bowl comprising:

a bottom, an upper annular rim, and upwardly extending side walls rising from the margin of the bottom and terminating at said annular rim, a portion of said annular rim defining an annular lip; and a cover comprising:

a domed panel having a downwardly extending peripheral flange thereabout, and an integrally formed annular skirt depending generally outwardly and downwardly from the peripheral flange, the inside surface of said annular skirt being formed with a locking member extending therefrom, said locking member designed to lockingly engage the annular lip of said bowl, said inside surface also being formed with a groove recessed therein, said groove being circumferentially spaced from said locking member, and said inside surface defining a radially inwardly facing transition surface between said locking member and said groove; and wherein, a discontinuous annular seal is formed by contact between the annular rim of said bowl and the annular skirt of said cover, with said groove defining a discontinuity in said annular seal, whereby said discontinuity provides a vent for said bowl and cover assembly, when said cover is securely interlocked onto said bowl; and wherein the annular lip of said bowl has a single annular top sealing surface and a single annular edge sealing surface depending downwardly from the top sealing surface and defining the outermost peripheral edge of the annular lip; and wherein said annular skirt is defined by an upwardly facing annular skirt shoulder around the outside surface of the cover and an inwardly facing annular heel at the junction between the peripheral flange and the annular skirt, the annular skirt comprising an upper laterally depending portion having a laterally disposed down facing mating surface, and a lower downwardly depending portion having an annular inwardly facing mating surface, said down facing mating surface adapted for contacting the top sealing surface of the bowl and the edge sealing surface adapted for contacting an annular portion of the inwardly facing mating surface; and wherein said bowl further comprises an external downwardly facing stacking shoulder positioned for resting on an annular rim of a second similarly shaped bowl when said bowl is nested within the inside of said second similarly shaped bowl; and wherein the annular skirt of the cover further comprises an annular trim lip integrally formed with the cover for defining a radially protruding circumferential member extending from the lower edge of the lower downwardly depending portion of the annular skirt remote from the peripheral flange, the junction between the trim lip and the lower downwardly depending portion defining an inwardly facing stacking heel, the length and shape of the annular skirt and the domed panel of the cover being selected so that the stacking heel of said cover rests on an annular skirt shoulder of a lower cover for preventing formation of a partial vacuum between said cover and said lower cover when the two covers are so stacked on top of one another; and wherein the portion of said annular skirt of the cover located between said groove and said locking member and defining said transition surface is cross-sectionally formed thinner than the portion of the annular skirt from which said locking member extends; and wherein said bottom of said bowl is comprised of an inwardly tapered surface, and said domed panel of said cover is comprised of an upwardly extending raised panel, whereby the selection of dimensions of said inwardly tapered surface are slightly larger than the dimensions of said raised panel, such that said raised panel of said cover can nest within said inwardly tapered surface of said bowl when said bowl is stacked on top of said cover; and wherein the bowl and cover assembly is formed from plastic foam material.

10. The bowl and cover assembly of claim 9, wherein said inside surface of said annular skirt is formed with a plurality of circumferentially-spaced grooves recessed therein.

* * * * *